US011610709B2

(12) United States Patent
Shiga et al.

(10) Patent No.: US 11,610,709 B2
(45) Date of Patent: Mar. 21, 2023

(54) ELECTRONIC COMPONENT

(71) Applicant: TDK CORPORATION, Tokyo (JP)

(72) Inventors: Yuto Shiga, Tokyo (JP); Hajime Kato, Tokyo (JP); Kazuya Tobita, Tokyo (JP); Youichi Kazuta, Tokyo (JP); Noriaki Hamachi, Tokyo (JP); Makoto Yoshino, Tokyo (JP)

(73) Assignee: TDK CORPORATION, Tokyo (JP)

( * ) Notice: Subject to any disclaimer, the term of this patent is extended or adjusted under 35 U.S.C. 154(b) by 795 days.

(21) Appl. No.: 16/538,465

(22) Filed: Aug. 12, 2019

(65) Prior Publication Data

US 2020/0066431 A1 Feb. 27, 2020

(30) Foreign Application Priority Data

Aug. 21, 2018 (JP) ..... JP2018-154645

(51) Int. Cl.

| | |
|---|---|
| ***H01F 17/00*** | (2006.01) |
| ***H01F 27/29*** | (2006.01) |
| ***H01F 27/30*** | (2006.01) |
| ***H01F 41/04*** | (2006.01) |
| ***H01F 41/10*** | (2006.01) |

(52) U.S. Cl.

CPC ..... *H01F 17/0013* (2013.01); *H01F 27/292* (2013.01); *H01F 27/306* (2013.01); *H01F 41/041* (2013.01); *H01F 41/10* (2013.01); *H01F 2017/0073* (2013.01)

(58) Field of Classification Search

CPC .. H01F 17/0013; H01F 27/292; H01F 27/306; H01F 41/041

See application file for complete search history.

(56) References Cited

U.S. PATENT DOCUMENTS

| | | | | |
|---|---|---|---|---|
| 2014/0253277 | A1* | 9/2014 | Takezawa | H01F 27/2804 336/200 |
| 2014/0285306 | A1* | 9/2014 | Sasaki | H01F 27/2804 336/200 |
| 2016/0372261 | A1* | 12/2016 | Ozawa | H01F 17/0013 |
| 2017/0098997 | A1 | 4/2017 | Hamada et al. | |
| 2017/0103848 | A1* | 4/2017 | Yoneda | H01F 17/0013 |
| 2017/0229247 | A1* | 8/2017 | Yoneda | H01F 17/0013 |
| 2019/0198225 | A1* | 6/2019 | Miyoshi | H01F 27/292 |

(Continued)

FOREIGN PATENT DOCUMENTS

| | | |
|---|---|---|
| CN | 106257603 A | 12/2016 |
| CN | 107068351 A | 8/2017 |

(Continued)

*Primary Examiner* — Elvin G Enad
*Assistant Examiner* — Malcolm Barnes
(74) *Attorney, Agent, or Firm* — Oliff PLC

(57) ABSTRACT

An electronic component includes an element provided with a recess, a mounting conductor disposed in the recess, and an internal conductor disposed inside the element and connected to the mounting conductor. A first region includes a first surface. A second region includes a third surface connecting a second surface and the first surface. The second surface and the third surface overlap with the first surface as viewed in a direction in which the first surface and the second surface face each other. The internal conductor is connected to the second region away from a connection portion between the first surface and the third surface.

10 Claims, 6 Drawing Sheets

(56) References Cited

U.S. PATENT DOCUMENTS

| | | | | |
|---|---|---|---|---|
| 2020/0027637 | A1* | 1/2020 | Sano | H01F 27/2804 |
| 2020/0304025 | A1* | 9/2020 | Hamada | G06F 1/3296 |

FOREIGN PATENT DOCUMENTS

| | | | |
|---|---|---|---|
| JP | 2014-175383 | A | 9/2014 |
| JP | 2017-143116 | A | 8/2017 |
| JP | 6269591 | B2 | 1/2018 |

* cited by examiner

ELECTRONIC COMPONENT

BACKGROUND OF THE INVENTION

1. Field of the Invention

The present invention relates to an electronic component.

2. Description of Related Art

Known electronic components include a chip and a mounting conductor provided on a surface of the chip. In the electronic components, the mounting conductor is formed on an outer surface of the chip, and thus the size of the chip is smaller by one size than a predetermined size of the electronic component. Therefore, the volume of the chip cannot be sufficiently provided in some cases. Japanese Patent No. 6269591 discloses an electronic component including an element, a mounting conductor disposed in a recess formed in the element, and an internal conductor connected to the mounting conductor. In this electronic component, the mounting conductor is disposed in the recess and is connected to the internal conductor.

SUMMARY OF THE INVENTION

In the electronic component disclosed in Japanese Patent No. 6269591, the mounting conductor is disposed in the recess. As a result, it is considered that the volume of the element is sufficiently provided. However, in the electronic component, cracks sometimes occur in the element.

An object of one aspect of the present invention is to provide an electronic component in which occurrence of cracks in an element is suppressed.

The present inventors have discovered the following facts from their research and study. The manufacturing process of the electronic component includes, for example, heat treatment. A constituent material of the mounting conductor and a constituent material of the internal conductor shrink due to the thermal treatment. The constituent materials of the mounting conductor and the internal conductor shrink larger than a constituent material of the element. For this reason, cracks easily occur in the element. Cracks easily occur in a vicinity between a region where the mounting conductor is exposed from the element and a region where the mounting conductor is covered by the element. If the volume of the mounting conductor is reduced, the shrinkage of the constituent material of the mounting conductor is reduced. However, to keep the mounting strength, the area of an outer surface of the mounting conductor needs to be maintained.

One aspect of the present invention includes an element, a mounting conductor, and an internal conductor. The element is provided with a recess. The mounting conductor is disposed in the recess. The internal conductor is disposed inside the element and is connected to the mounting conductor. The mounting conductor has a first region exposed from the element and a second region connected to the first region and covered by the element. The first region includes a first surface. The second region includes a second surface facing the first surface and a third surface connecting the second surface and the first surface. The second surface and the third surface overlap with the first surface as viewed in a direction in which the first surface and the second surface face each other. The internal conductor is connected to the second region away from a connection portion between the first surface and the third surface.

In the one aspect, the second surface and the third surface overlap with the first surface as viewed in the direction in which the first surface and the second surface face each other. In this case, the volume of the mounting conductor is reduced in a portion where the third surface connected to the second surface is provided while a surface area of the first region is maintained, as compared with a case where the second surface and the third surface are provided not to overlap with the first surface. In this electronic component, the internal conductor is connected to the second region away from the connection portion between the first surface and the third surface. Thus, the portion where the volume of the mounting conductor is reduced is not filled with the constituent material of the internal conductor in the vicinity between the region where the mounting conductor is exposed from the element and the region where the mounting conductor is covered by the element. Therefore, the shrinkage of the constituent materials of the mounting conductor and the internal conductor is reduced at a position where cracks easily occur, and thus the occurrence of cracks in the element is suppressed.

In the one aspect, an angle made by the first surface and a plane that passes through the connection portion between the first surface and the third surface and passes through a connection portion between the second surface and the third surface may be an acute angle. In this case, in the vicinity between the region where the mounting conductor is exposed from the element and the region where the mounting conductor is covered by the element, the volume of the mounting conductor is further reduced.

In the one aspect, the third surface may be located closer to the second surface than a plane passing through the connection portion between the first surface and the third surface and orthogonal to the first surface. In this case, in the vicinity between the region where the mounting conductor is exposed from the element and the region where the mounting conductor is covered by the element, the volume of the mounting conductor is further reduced.

In the one aspect, the first region may further include a mounting surface connected to the first surface and extending in a direction intersecting with the first surface. The internal conductor may be connected to at least one of the second surface and the third surface. In this case, in a case where the electronic component is mounted on another electronic component, an influence of another electronic component on electromagnetic characteristics of a connection portion between the internal conductor and the mounting conductor is suppressed. For example, in a case where the internal conductor is a coil conductor, generation of magnetic flux in the connection portion between the internal conductor and the mounting conductor is less likely to be inhibited by another electronic component. For this reason, the decrease in Q value (quality factor) of the coil is suppressed. For example, in a case where the electronic component is mounted on another electronic device by solder connection, since the solder is provided not only on the mounting surface but also on the first surface, the mounting strength can be increased.

In the one aspect, the internal conductor may be connected to the connection portion between the second surface and the third surface. In this case, the influence of another electronic component on the electromagnetic characteristics of the connection portion between the internal conductor and the mounting conductor is suppressed, the shrinkage of the constituent materials of the mounting conductor and the internal conductor at the position where cracks easily occur is reduced, and the suppression and the reduction are balanced.

In the one aspect, the internal conductor may be connected to the mounting conductor only on the second surface. In this case, the shrinkage of the constituent materials of the mounting conductor and the internal conductor at the position where cracks easily occur is reduced.

In the one aspect, the second region may include a fourth surface facing the mounting surface, and a fifth surface connecting the fourth surface and the mounting surface. The fourth surface of the second region may be connected to the second surface. The fourth surface and the fifth surface may overlap with the mounting surface as viewed in the direction in which the mounting surface and the fourth surface face each other. In this case, the volume of the mounting conductor is further reduced. Therefore, the shrinkage of the constituent materials of the mounting conductor and the internal conductor at the position where cracks easily occur is further reduced.

In the one aspect, the mounting conductor may have an L-shape in cross section in a direction orthogonal to a direction in which the first surface and the second surface face each other and to a direction in which the mounting surface and the fourth surface face each other. In this case, a space inside the element is provided.

In the one aspect, the third surface may be curved. For example, in a case where the third surface is configured by a plurality of planes and has a chamfered shape, there is a possibility of concentration of stress on corner portions of the third surface. In contrast, in the electronic component, since the third surface is curved, the stress is relieved. Therefore, the occurrence of cracks in the element is further suppressed.

In the above one aspect, a relationship $0.75a \leq b \leq 2a$ may be satisfied where a shortest distance from a connection portion between the second surface and the third surface to the first surface is "a", and a shortest distance from the connection portion between the first surface and the third surface to the connection portion between the second surface and the third surface as viewed in the direction in which the first surface and the second surface face each other is "b". In this case, with $0.75a \leq b$, the angle between the first surface and the third surface becomes sufficiently large. Therefore, in the vicinity between the region where the mounting conductor is exposed from the element and the region where the mounting conductor is covered by the element, concentration of stress is suppressed. Further, with $b \leq 2a$, the volume of the mounting conductor can be sufficiently reduced. Therefore, the shrinkage of the constituent material of the mounting conductor is reduced. Therefore, the occurrence of cracks in the element is further suppressed.

In the one aspect, the internal conductor may include a coil conductor that configures a coil in the element and a connection conductor that connects the coil conductor to the mounting conductor. The mounting conductor may be formed by laminating mounting conductor layers. A coil axis of the coil may be provided along a laminating direction of the mounting conductor layers. The connection conductor may be connected to the second region away from the connection portion between the first surface and the third surface. In this case, the outer diameter of the coil can be increased while the surface area of the first region is maintained, as compared with a case where the second surface and the third surface are provided not to overlap with the first surface. As a result, the Q value of the coil can be improved.

The present invention will become more fully understood from the detailed description given hereinafter and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF EMBODIMENTS

Figure 1:
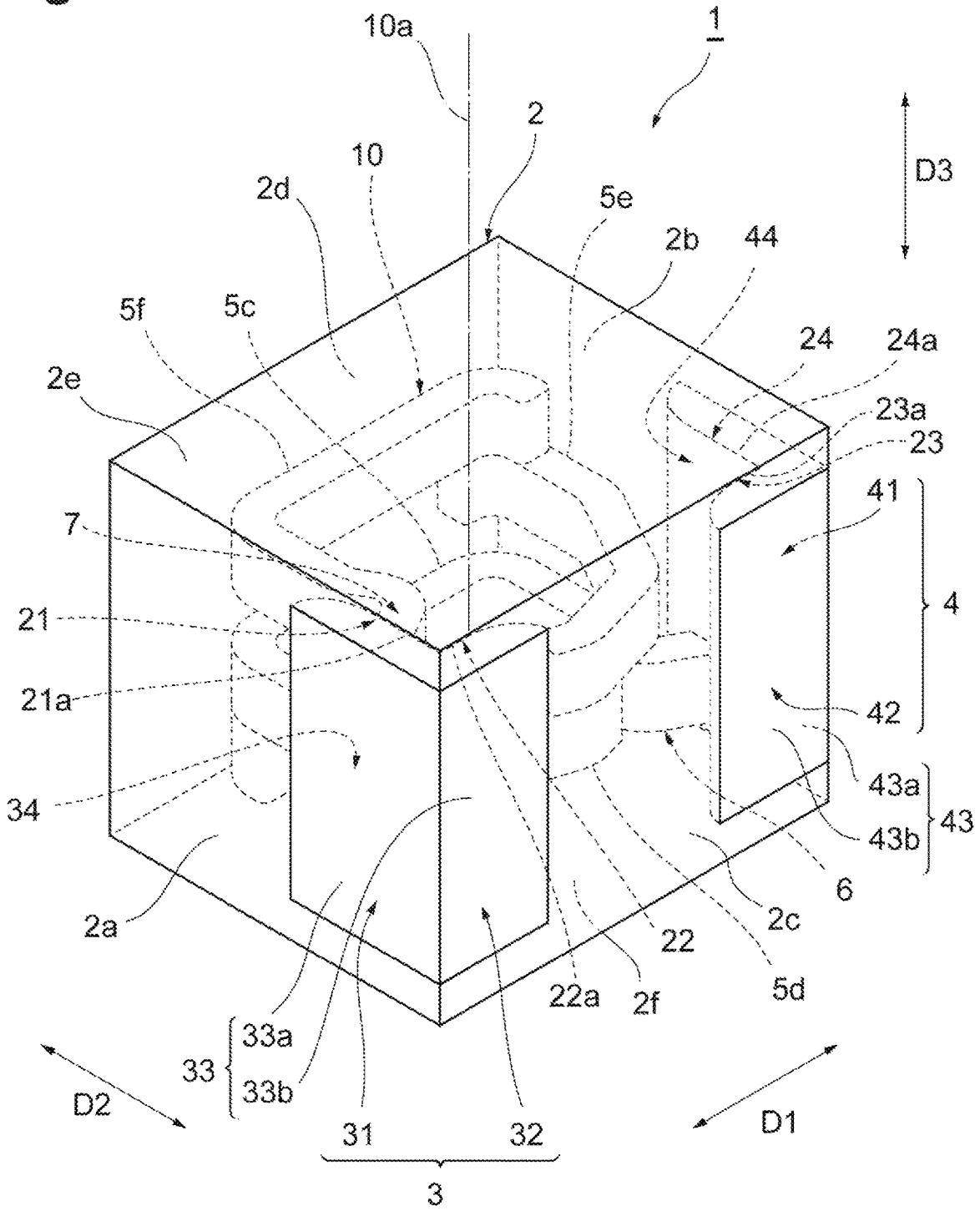
FIG. 1 is a perspective view of a multilayer coil component according to the present embodiment.

Hereinafter, embodiments of the present invention will be described in detail with reference to the accompanying drawings. In the description, the same reference numerals are used for the same elements or elements having the same function, and redundant explanations will be omitted.

Figure 2:
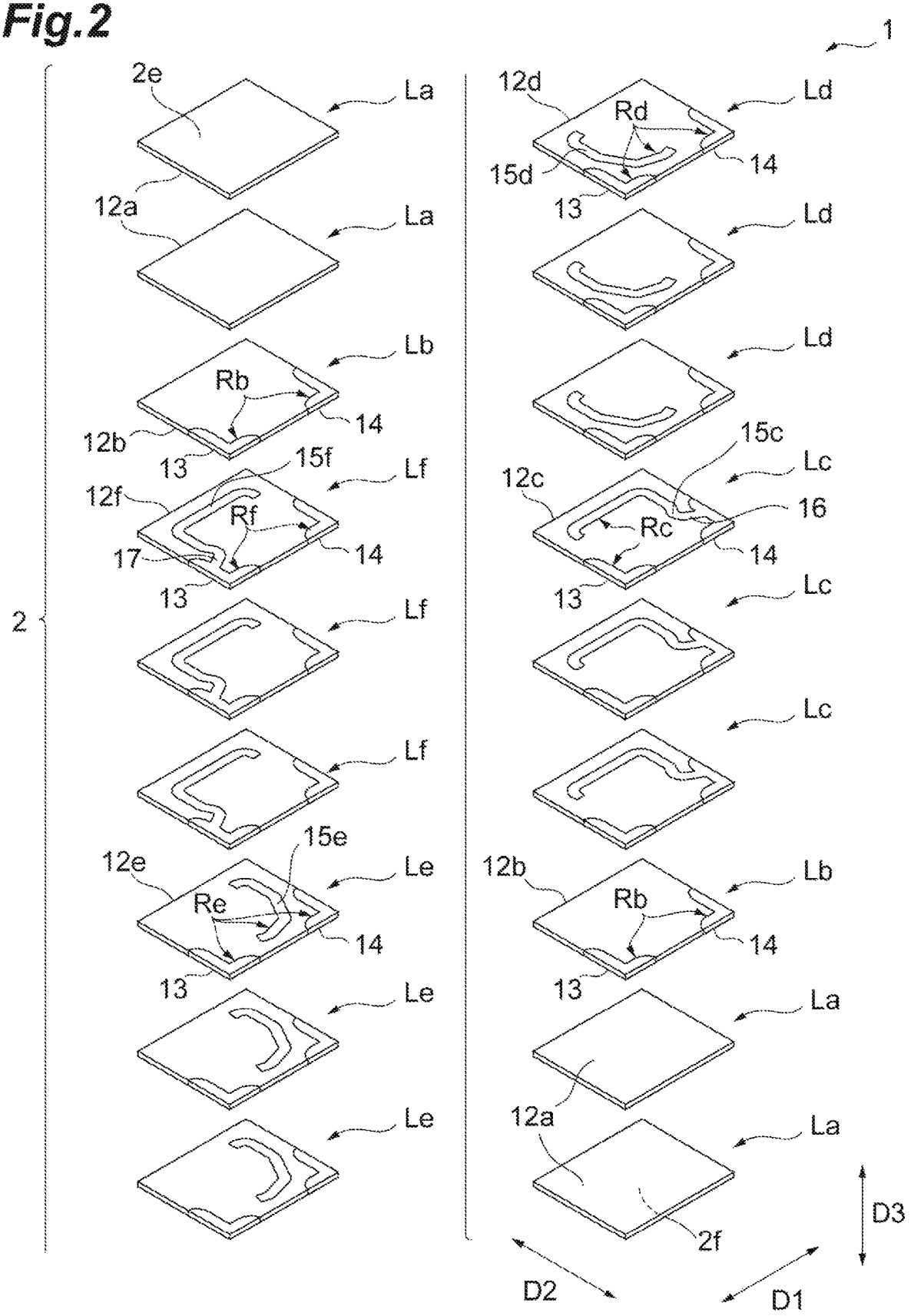
FIG. 2 is an exploded perspective view of the multilayer coil component in FIG. 1.
Figure 3:
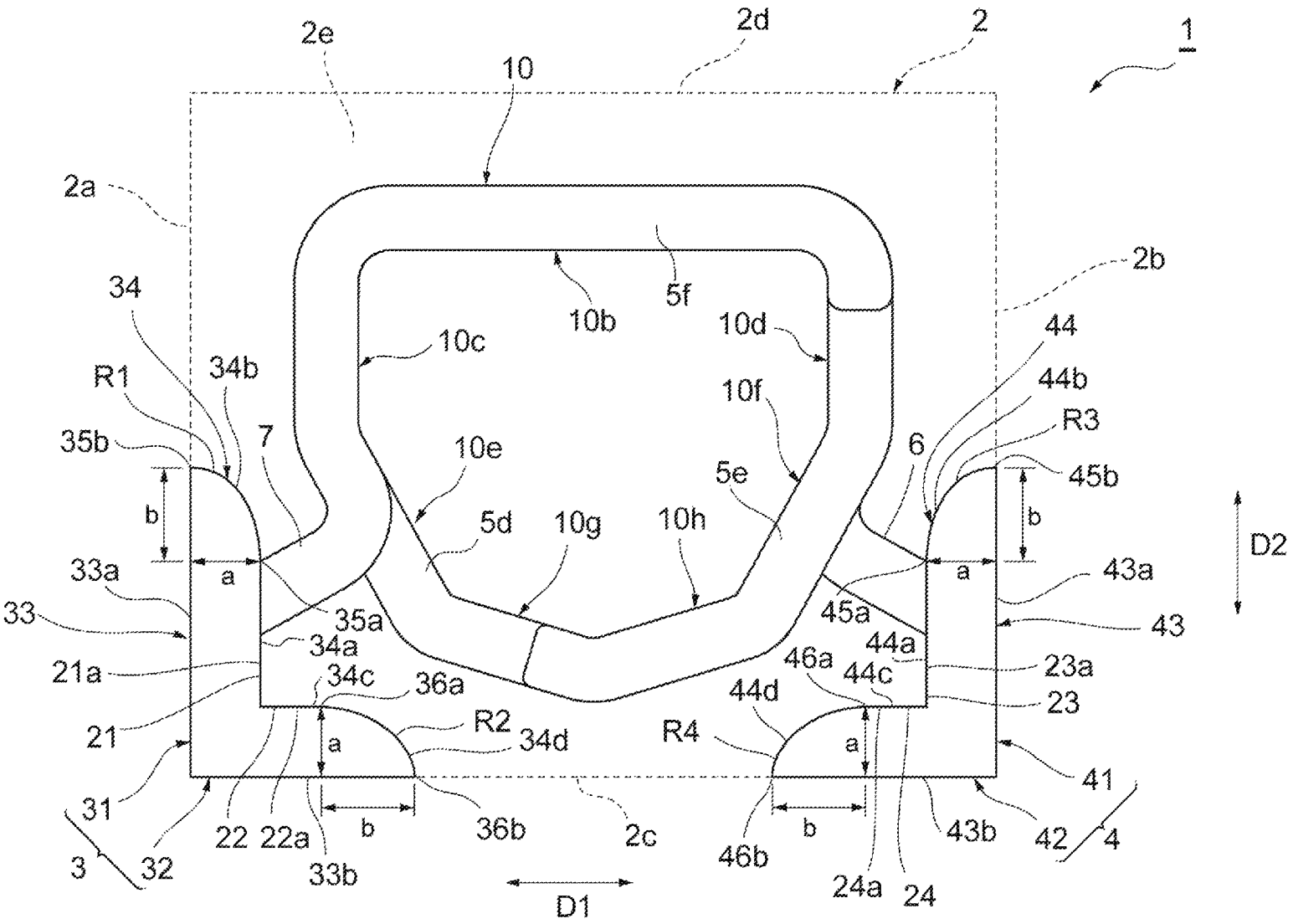
FIG. 3 is a plan view illustrating a relationship between a coil and a mounting conductor illustrated in FIG. 1.

A multilayer coil component according to an embodiment will be described with reference to FIGS. 1 to 3. FIG. 1 is a perspective view of a multilayer coil component according to an embodiment. FIG. 2 is an exploded perspective view of the multilayer coil component illustrated in FIG. 1. FIG. 3 is a plan view illustrating a relationship between a coil and a mounting conductor illustrated in FIG. 1. FIG. 3 is a plan view of a multilayer coil component 1 as viewed from a side surface 2*e* side, and an element 2 is illustrated by the broken line.

As illustrated in FIGS. 1 to 3, the multilayer coil component 1 according to the embodiment includes the element 2, mounting conductors 3 and 4, and an internal conductor 5.

As illustrated in FIG. 1, the multilayer coil component 1 has a rectangular parallelepiped shape. The rectangular parallelepiped shape includes a rectangular parallelepiped shape with chamfered corner portions and ridge portions, and a rectangular parallelepiped shape with rounded corner portions and ridge portions. The multilayer coil component 1 has end surfaces 2*a* and 2*b* and side surfaces 2*c*, 2*d*, 2*e*, and 2*f*. The end surface 2*a* is formed of the element 2 and the mounting conductor 3. The end surface 2*b* is formed of the element 2 and the mounting conductor 4. The side surface 2*c* is formed of the element 2 and the mounting conductors 3 and 4. The side surfaces 2*d*, 2*e*, and 2*f* are formed of the element 2.

The end surfaces 2*a* and 2*b* face each other. The side surfaces 2*c* and 2*d* face each other. The side surfaces 2*e* and 2*f* face each other. Hereinafter, a direction in which the end surfaces 2*a* and 2*b* face each other is referred to as "direction D1", a direction in which the side surfaces 2*c* and 2*d* face each other is referred to as "direction D2", and a direction in which the side surfaces 2*e* and 2*f* face each other is referred to as "direction D3". The directions D1, D2, and D3 are approximately orthogonal to one another.

The end surfaces 2*a* and 2*b* extend in the direction D2 to connect the side surfaces 2*c* and 2*d*. The end surfaces 2*a* and 2*b* also extend in the direction D3 to connect the side surfaces 2*e* and 2*f*. The side surfaces 2*c* and 2*d* extend in the direction D1 to connect the end surfaces 2*a* and 2*b*. The side surfaces 2*c* and 2*d* also extend in the direction D3 to connect the side surfaces 2*e* and 2*f*. The side surfaces 2*e* and 2*f* extend in the direction D2 to connect the side surfaces 2*c* and 2*d*. The side surfaces 2*e* and 2*f* also extend in the direction D1 to connect the end surfaces 2*a* and 2*b*.

The side surface 2*c* is a surface facing another electronic device (not illustrated) in mounting the multilayer coil component 1 on another electronic device. Another electronic device is, for example, a circuit base material or an electronic component. The end surfaces 2*a* and 2*b* are surfaces continuing from the side surface 2*c*.

The length of the multilayer coil component 1 in the direction D1 is longer than the length of the multilayer coil component 1 in the direction D2 and the length of the multilayer coil component 1 in the direction D3. The length of the multilayer coil component 1 in the direction D2 and the length of the multilayer coil component 1 in the direction D3 are equal to each other. The end surfaces 2*a* and 2*b* have a square shape, and the side surfaces 2*c*, 2*d*, 2*e*, and 2*f* have a rectangular shape. The length of the multilayer coil component 1 in the direction D1 may be equal to or shorter than the length of the multilayer coil component 1 in the direction D2 and the length of the multilayer coil component 1 in the direction D3. The length of the multilayer coil component 1 in the direction D2 and the length of the multilayer coil component 1 in the direction D3 may be different from each other.

The "equal" in the present embodiment may include values having a slight difference or a manufacturing error that falls within a preset range, in addition to identical values. For example, if a plurality of values falls within a range of ±5% of an average value of the plurality of values, the plurality of values is defined to be equal.

As illustrated in FIG. 1, the element 2 is exposed at a part of the end surfaces 2*a* and 2*b*, a part of the side surface 2*c*, and the side surfaces 2*d*, 2*e*, and 2*f*. In other words, the element 2 forms the part of the end surfaces 2*a* and 2*b*, the part of the side surface 2*c*, and the side surfaces 2*d*, 2*e*, and 2*f*. Recesses 21, 22, 23, and 24 are provided in the element 2. The recesses 21 and 22 are integrally provided and correspond to the mounting conductor 3. The recesses 23 and 24 are integrally provided and correspond to the mounting conductor 4.

The recess 21 is provided in the end surface 2*a* close to the side surface 2*c* and is depressed toward the end surface 2*b*. The recess 21 has a bottom surface 21*a*. The bottom surface 21*a* has a rectangular shape, for example. The recess 22 is provided in the side surface 2*c* close to the end surface 2*a* and is depressed toward the side surface 2*d*. The recess 22 has a bottom surface 22*a*. The bottom surface 22*a* has a rectangular shape, for example. The recess 23 is provided in the end surface 2*b* close to the side surface 2*c* and is depressed toward the end surface 2*a*. The recess 23 has a bottom surface 23*a*. The bottom surface 23*a* has a rectangular shape, for example. The recess 24 is provided in the side surface 2*c* close to the end surface 2*b* and is depressed toward the side surface 2*d*. The recess 24 has a bottom surface 24*a*. The bottom surface 24*a* has a rectangular shape, for example.

The recess 21 and the recess 22 form an integral hollow portion on the end surface 2*a* side and the side surface 2*c* side of the element 2. The recess 23 and the recess 24 form an integral hollow portion on the end surface 2*b* side and the side surface 2*c* side of the element 2. The recess 22 and the recess 24 are provided away from each other in the direction D1. The recesses 21, 22, 23, and 24 have the same shape, for example. The recesses 21, 22, 23, and 24 are provided away from the side surfaces 2*d*, 2*e*, and 2*f*.

As illustrated in FIG. 2, the element 2 is configured by laminating a plurality of element layers 12*a* to 12*f* in the direction D3. A specific lamination structure will be described below. In the actual element 2, the plurality of element layers 12*a* to 12*f* are integrated to such an extent that boundaries between the element layers cannot be visually recognized. The element layers 12*a* to 12*f* are configured by, for example, a magnetic material. The magnetic material includes an Ni—Cu—Zn ferrite material, an Ni—Cu—Zn—Mg ferrite material, or an Ni—Cu ferrite material. The magnetic material that configures the element layers 12*a* to 12*f* may contain an Fe alloy or the like. The element layers 12*a* to 12*f* may be configured by a nonmagnetic material. The nonmagnetic material includes a glass ceramic material, a dielectric material, or the like.

As illustrated in FIG. 1, the mounting conductor 3 is disposed in the recesses 21 and 22. The mounting conductor 4 is disposed in the recesses 23 and 24. The mounting conductors 3 and 4 are away from each other in the direction D1. The mounting conductors 3 and 4 have the same shape, for example. The mounting conductors 3 and 4 have an L-shape in cross section, for example. The mounting conductors 3 and 4 can be said to have an L shape as viewed in the direction D3, for example. Electrolytic plating or electroless plating is applied to the mounting conductors 3 and 4, and thereby a plating layer is formed on outer surfaces. The plating layer contains, for example, Ni, Sn, Au, or the like.

As illustrated in FIG. 2, the mounting conductor 3 is configured by laminating a plurality of mounting conductor layers 13 in the direction D3. The plurality of mounting conductor layers 13 have an L shape as viewed in the direction D3. That is, the laminating direction of the mounting conductor layers 13 corresponds to the direction D3. In the mounting conductor 3, the plurality of mounting conductor layers 13 are integrated to such an extent that boundaries between the layers cannot be visually recognized.

The mounting conductor 3 has integrally formed conductor portions 31 and 32. The conductor portions 31 and 32 have a rectangular shape in cross section. In the present embodiment, the longitudinal length of the conductor portion 31 is longer than the longitudinal length of the conductor portion 32. The conductor portions 31 and 32 may have the same shape. The mounting conductor 3 has a first region 33 exposed from the element 2 and a second region 34 covered by the element 2. Each of the conductor portions 31 and 32 has the first region 33 and the second region 34. In each of the conductor portion 31 and conductor portion 32, the first region 33 and the second region 34 are connected to each other.

As illustrated in FIG. 1, the first region 33 of the mounting conductor 3 includes a first surface 33*a* and a mounting surface 33*b* extending in a direction intersecting with the first surface 33*a*. The first surface 33*a* and the mounting surface 33*b* are connected to each other. In the present embodiment, the first surface 33*a* and the mounting surface 33*b* are orthogonal to each other. The first surface 33*a* forms a part of the end surface 2*a*. The mounting surface 33*b* forms a part of the side surface 2*c*. The second region 34 includes a second surface 34*a*, a third surface 34*b*, a fourth surface 34*c*, and a fifth surface 34*d*.

The conductor portion 31 is disposed in the recess 21. The conductor portion 31 includes the first surface 33*a* of the first region 33 and the second surface 34*a* and the third surface 34*b* of the second region 34. In the direction D1, the second surface 34*a* of the second region 34 faces the bottom surface 21*a* and also faces the first surface 33*a* of the first region 33. The second surface 34*a* is covered by the bottom surface 21*a*. The third surface 34*b* connects the first surface 33*a* of the first region 33 and the second surface 34*a* of the second region 34.

The third surface 34*b* is located closer to the second surface 34*a* than a plane that passes through a connection portion between the first surface 33*a* and the third surface 34*b*, and is orthogonal to the first surface 33*a* and parallel to the mounting surface 33*b*. A contact angle between the first surface 33*a* and the third surface 34*b* is an acute angle. The contact angle may be 90°. An angle made by the first surface 33*a* and a plane that passes through the connection portion between the first surface 33*a* and the third surface 34*b* and passes through a connection portion between the second surface 34*a* and the third surface 34*b* is an acute angle.

The second surface 34*a* and the third surface 34*b* overlap with the first surface 33*a* of the first region 33 as viewed from a direction in which the first surface 33*a* and the second surface 34*a* face each other. In the present embodiment, the second surface 34*a* is a plane parallel to the bottom surface 21*a* and the first surface 33*a*. The third surface 34*b* is curved to protrude toward the end surface 2*b* and the side surface 2*d*. The third surface 34*b* has a region R1 overlapping with the first surface 33*a* of the first region 33 as viewed in the direction D1. The region R1 is curved in whole.

The second surface 34*a* has an outer edge 35*a* that defines the region R1. The first surface 33*a* of the first region 33 has an outer edge 35*b* that defines the region R1. The outer edges 35*a* and 35*b* extend along the direction D3 and are parallel to each other. The outer edge 35*a* is located closer to the side surface 2*c* than the outer edge 35*b* as viewed in the direction D1. A relationship $0.75a \leq b \leq 2a$ is satisfied where a separation distance between the outer edge 35*a* and the outer edge 35*b* in the direction D1 is "a" and a separation distance between the outer edge 35*a* and the outer edge 35*b* in the direction D2 is "b". In other words, the separation distance "a" is the shortest distance from the connection portion between the second surface 34*a* and the third surface 34*b* to the first surface 33*a*. The separation distance "b" is the shortest distance from the connection portion between the first surface 33*a* and the third surface 34*b* to the connection portion between the second surface 34*a* and the third surface 34*b* as viewed from the direction in which the first surface 33*a* and the second surface 34*a* face each other.

The conductor portion 32 is disposed in the recess 22. The conductor portion 32 includes the mounting surface 33*b* of the first region 33 and the fourth surface 34*c* and the fifth surface 34*d* of the second region 34. The mounting surface 33*b* is connected to the first surface 33*a*. The length of the mounting surface 33*b* in the direction D1 is longer than the length of the first surface 33*a* in the direction D2. The fourth surface 34*c* is connected to the second surface 34*a*. In the direction D2, the fourth surface 34*c* of the second region 34 faces the bottom surface 22*a* and also faces the mounting surface 33*b* of the first region 33. The fourth surface 34*c* is covered by the bottom surface 22*a*. The fifth surface 34*d* connects the mounting surface 33*b* of the first region 33 and the fourth surface 34*c* of the second region 34.

The fifth surface 34*d* is located closer to the fourth surface 34*c* than a plane that passes through a connection portion between the mounting surface 33*b* and the fifth surface 34*d*, and is orthogonal to the mounting surface 33*b*. A contact angle between the mounting surface 33*b* and the fifth surface 34*d* is an acute angle. The contact angle may be 90°. An angle made by the mounting surface 33*b* and a plane that passes through the connection portion between the mounting surface 33*b* and the fifth surface 34*d* and passes through a connection portion between the fourth surface 34*c* and the fifth surface 34*d* is an acute angle.

The fourth surface 34*c* and the fifth surface 34*d* overlap with the mounting surface 33*b* of the first region 33 as viewed from a direction in which the mounting surface 33*b* and the fourth surface 34*c* face each other. In the present embodiment, the fourth surface 34*c* is a plane parallel to the bottom surface 22*a* and the mounting surface 33*b*. That is, the second surface 34*a* and the fourth surface 34*c* are orthogonal to each other. The fifth surface 34*d* is curved to protrude toward the end surface 2*b* and the side surface 2*d*. The fifth surface 34*d* has a region R2 overlapping with the mounting surface 33*b* of the first region 33 as viewed in the direction D2. The region R2 is curved in whole.

The fourth surface 34*c* has an outer edge 36*a* that defines the region R2. The mounting surface 33*b* of the first region 33 has an outer edge 36*b* that defines the region R2. The outer edges 36*a* and 36*b* extend along the direction D3 and are parallel to each other. The outer edge 36*a* is located closer to the end surface 2*a* than the outer edge 36*b* as viewed in the direction D2. The relationship $0.75a \leq b \leq 2a$ is satisfied where a separation distance between the outer edge 36*a* and the outer edge 36*b* in the direction D2 is "a" and a separation distance between the outer edge 36*a* and the outer edge 36*b* in the direction D1 is "b". In other words, the separation distance "a" is the shortest distance from the connection portion between the fourth surface 34*c* and the fifth surface 34*d* to the mounting surface 33*b*. The separation distance "b" is the shortest distance from the connection portion between the mounting surface 33*b* and the fifth surface 34*d* to the connection portion between the fourth surface 34*c* and the fifth surface 34*d* as viewed from the direction in which the mounting surface 33*b* and the fourth surface 34*c* face each other.

The mounting conductor 4 is configured by laminating a plurality of mounting conductor layers 14 having an L shape as viewed in the direction D3 in the direction D3. That is, a laminating direction of the mounting conductor layers 14 corresponds to the direction D3. In the mounting conductor 4, the plurality of mounting conductor layers 14 are integrated to such an extent that boundaries between the layers cannot be visually recognized.

The mounting conductor 4 has integrally formed conductor portions 41 and 42. The conductor portions 41 and 42 have a rectangular shape in cross section. The conductor portions 41 and 42 have the same shape, for example. The mounting conductor 4 has a first region 43 exposed from the element 2 and a second region 44 covered by the element 2. Each of the conductor portions 41 and 42 has the first region 43 and the second region 44. In each of the conductor portion 41 and the conductor portion 42, the first region 43 and the second region 44 are connected to each other.

As illustrated in FIG. 1, the first region 43 of the mounting conductor 4 includes a first surface 43*a* and a mounting surface 43*b* extending in a direction intersecting with the first surface 43*a*. The first surface 43*a* and the mounting surface 43*b* are connected to each other. In the present embodiment, the first surface 43*a* and the mounting surface 43*b* are orthogonal to each other. The first surface 43*a* forms a part of the end surface 2*b*. The mounting surface 43*b* forms a part of the side surface 2*c*. The second region 44 includes a second surface 44*a*, a third surface 44*b*, a fourth surface 44*c*, and a fifth surface 44*d*.

The conductor portion 41 is disposed in the recess 23. The conductor portion 41 includes the first surface 43*a* of the first region 43 and the second surface 44*a* and the third surface 44*b* of the second region 44. In the direction D1, the second surface 44*a* of the second region 44 faces the bottom surface 23*a* and faces the first surface 43*a* of the first region 43. The second surface 44*a* is covered by the bottom surface 23*a*. The third surface 44*b* connects the first surface 43*a* of the first region 43 and the second surface 44*a* of the second region 44.

The third surface 44*b* is located closer to the second surface 44*a* than a plane that passes through a connection portion between the first surface 43*a* and the third surface 44*b*, and is orthogonal to the first surface 43*a*. A contact angle between the first surface 43*a* and the third surface 44*b* is an acute angle. The contact angle may be 90°. An angle made by the first surface 43*a* and a plane that passes through the connection portion between the first surface 43*a* and the third surface 44*b* and passes through a connection portion between the second surface 44*a* and the third surface 44*b* is an acute angle.

The second surface 44*a* and the third surface 44*b* overlap with the first surface 43*a* of the first region 43 as viewed from a direction in which the first surface 43*a* and the second surface 44*a* face each other. In the present embodiment, the second surface 44*a* is a plane parallel to the bottom surface 23*a* and the first surface 43*a*. The third surface 44*b* is curved to protrude toward the end surface 2*b* and the side surface 2*d*. The third surface 44*b* has a region R3 overlapping with the first surface 43*a* of the first region 43 as viewed in the direction D1. The region R3 is curved in whole.

The second surface 44*a* has an outer edge 45*a* that defines the region R3. The first surface 43*a* of the first region 43 has an outer edge 45*b* that defines the region R3. The outer edges 45*a* and 45*b* extend along the direction D3 and are parallel to each other. The outer edge 45*a* is located closer to the side surface 2*c* than the outer edge 45*b* as viewed in the direction D1. The relationship $0.75a \leq b \leq 2a$ is satisfied where a separation distance between the outer edge 45*a* and the outer edge 45*b* in the direction D1 is "a" and a separation distance between the outer edge 45*a* and the outer edge 45*b* in the direction D2 is "b". In other words, the separation distance "a" is the shortest distance from the connection portion between the second surface 44*a* and the third surface 44*b* to the first surface 43*a*. The separation distance "b" is the shortest distance from the connection portion between the first surface 43*a* and the third surface 44*b* to the connection portion between the second surface 44*a* and the third surface 44*b* as viewed from the direction in which the first surface 43*a* and the second surface 44*a* face each other.

The conductor portion 42 is disposed in the recess 24. The conductor portion 42 includes the mounting surface 43*b* of the first region 43 and the fourth surface 44*c* and the fifth surface 44*d* of the second region 44. The mounting surface 43*b* is connected to the first surface 43*a*. The length of the mounting surface 43*b* in the direction D1 is longer than the length of the first surface 43*a* in the direction D2. The fourth surface 44*c* is connected to the second surface 44*a*. In the direction D2, the fourth surface 44*c* of the second region 44 faces the bottom surface 24*a* and also faces the mounting surface 43*b* of the first region 43. The fourth surface 44*c* is covered by the bottom surface 24*a*. The fifth surface 44*d* connects the mounting surface 43*b* of the first region 43 and the fourth surface 44*c* of the second region 44.

The fifth surface 44*d* is located closer to the fourth surface 44*c* than a plane that passes through a connection portion between the mounting surface 43*b* and the fifth surface 44*d*, and is orthogonal to the mounting surface 43*b*. A contact angle between the mounting surface 43*b* and the fifth surface 44*d* is an acute angle. The contact angle may be 90°. An angle made by the mounting surface 43*b* and a plane that passes through the connection portion between the mounting surface 43*b* and the fifth surface 44*d* and passes through a connection portion between the fourth surface 44*c* and the fifth surface 44*d* is an acute angle.

The fourth surface 44*c* and the fifth surface 44*d* overlap with the mounting surface 43*b* of the first region 43 as viewed from a direction in which the mounting surface 43*b* and the fourth surface 44*c* face each other. In the present embodiment, the fourth surface 44*c* is a plane parallel to the bottom surface 24*a* and the mounting surface 43*b*. That is, the second surface 44*a* and the fourth surface 44*c* are orthogonal to each other. The fifth surface 44*d* is curved to protrude toward the end surface 2*b* and the side surface 2*d*. The fifth surface 44*d* has a region R4 overlapping with the mounting surface 43*b* of the first region 43 as viewed in the direction D2. The region R4 is curved in whole.

The fourth surface 44*c* has an outer edge 46*a* that defines the region R4. The mounting surface 43*b* of the first region 43 has an outer edge 46*b* that defines the region R4. The outer edges 46*a* and 46*b* extend along the direction D3 and are parallel to each other. The outer edge 46*a* is located closer to the end surface 2*a* than the outer edge 46*b* as viewed in the direction D2. The relationship $0.75a \leq b \leq 2a$ is satisfied where a separation distance between the outer edge 46*a* and the outer edge 46*b* in the direction D2 is "a" and a separation distance between the outer edge 46*a* and the outer edge 46*b* in the direction D2 is "b". In other words, the separation distance a is the shortest distance from the connection portion between the fourth surface 44*c* and the fifth surface 44*d* to the mounting surface 43*b*. The separation distance "b" is the shortest distance from the connection portion between the mounting surface 43*b* and the fifth surface 44*d* to the connection portion between the fourth surface 44*c* and the fifth surface 44*d* as viewed from the direction in which the mounting surface 43*b* and the fourth surface 44*c* face each other.

The internal conductor 5 is disposed inside the element 2 and connected to the mounting conductors 3 and 4. The internal conductor 5 includes a plurality of coil conductors 5*c*, 5*d*, 5*e*, and 5*f*, and connection conductors 6 and 7.

The plurality of coil conductors 5*c*, 5*d*, 5*e*, and 5*f* are connected to one another to configure a coil 10 in the element 2. The coil 10 is disposed to face the third surfaces 34*b* and 44*b* and the fifth surfaces 34*d* and 44*d*. A coil axis 10*a* of the coil 10 is provided along the direction D3. The coil conductors 5*c*, 5*d*, 5*e*, and 5*f* are disposed to at least partially overlap with one another as viewed in the direction D3. The coil conductors 5*c*, 5*d*, 5*e*, and 5*f* are disposed away from the end surfaces 2*a* and 2*b* and the side surfaces 2*c*, 2*d*, 2*e*, and 2*f*. The coil 10 is connected to the mounting conductors 3 and 4 through the connection conductors 6 and 7. In the present embodiment, the coil 10 has a spiral structure ascending counterclockwise along the coil axis 10*a*.

As illustrated in FIG. 3, the coil 10 has a line-symmetrical shape as viewed in the direction D3. In the present embodiment, the coil 10 has a substantially heptagonal shape as viewed in the direction D3, and each corner is rounded. The length of the coil 10 in the direction D1 is from 30% to 98%, both inclusive, and more favorably from 60% to 98%, both inclusive, of the length of the multilayer coil component 1 in the direction D1 as viewed in the direction D2. The length of the coil 10 in the direction D2 is from 10% to 90%, both inclusive, and more favorably from 10% to 50%, both inclusive, of the length of the multilayer coil component 1 in the direction D2 as viewed in the direction D1.

The coil 10 is disposed in a central portion of the multilayer coil component 1 in the direction D1 as viewed in the direction D2. That is, a separation distance between the coil 10 and the end surface 2*a* in the direction D1 and a separation distance between the coil 10 and the end surface 2*b* in the direction D1 are equal to each other. A separation distance between the coil 10 and the side surface 2*d* in the direction D2 is from 1.5% to 30%, both inclusive, and more favorably from 1.5% to 10%, both inclusive, of the length of the multilayer coil component 1 in the direction D2. The separation distance between the coil 10 and the side surface 2*c* in the direction D2 is from 1.5% to 60%, both inclusive, and more favorably from 1.5% to 10%, both inclusive, of the length of the multilayer coil component 1 in the direction D2.

The coil 10 has portions 10*b*, 10*c*, 10*d*, 10*e*, 10*f*, 10*g*, and 10*h*. Each of the portions 10*b*, 10*e*, 10*d*, 10*e*, 10*f*, 10*g*, and 10*h* has a shape with rounded corners. In the present embodiment, the coil 10 has a line-symmetrical shape as viewed in the direction D3.

The portion 10*b* is disposed along the side surface 2*d*. The length of the portion 10*b* in the direction D1 is from 30% to 98%, both inclusive, and more favorably from 60% to 98%, both inclusive, of the length of the multilayer coil component 1 in the direction D1. The portion 10*b* is disposed in a central portion of the multilayer coil component 1 in the direction D1. That is, a separation distance between the portion 10*b* and the end surface 2*a* in the direction D1 and a separation distance between the portion 10*b* and the end surface 2*b* in the direction D1 are equal to each other. A separation distance between the portion 10*b* and the side surface 2*d* in the direction D2 is from 1.5% to 30%, both inclusive, and more favorably from 1.5% to 10%, both inclusive, of the length of the multilayer coil component 1 in the direction D2.

The portion 10*c* is connected to an end portion of the portion 10*b* on the end surface 2*a* side and is disposed along the end surface 2*a*. The length of the portion 10*c* in the direction D2 is from 10% to 90%, both inclusive, and more favorably from 10% to 50%, both inclusive, of the length of the multilayer coil component 1 in the direction D2.

The portion 10*d* is connected to an end portion of the portion 10*b* on the end surface 2*b* side and is disposed along the end surface 2*b*. The length of the portion 10*d* in the direction D2 is from 10% to 90%, both inclusive, and more favorably from 10% to 50%, both inclusive, of the length of the multilayer coil component 1 in the direction D2. The portion 10*d* has, for example, the same shape as the portion 10*c*.

The portion 10*e* is connected to an end portion of the portion 10*c* on the side surface 2*c* side, and extends from a connection portion with the portion 10*c* toward the end surface 2*b* and the side surface 2*c*. The portion 10*f* is connected to an end portion of the portion 10*d* on the side surface 2*c* side, and extends from a connection portion with the portion 10*d* toward the end surface 2*a* and the side surface 2*c*. The portion 10*f* has, for example, a line-symmetrical shape with the portion 10*e*.

The portion 10*g* is connected to an end portion of the portion 10*e* on the side surface 2*c* side, and extends from a connection portion with the portion 10*e* toward the end surface 2*b* and the side surface 2*c*. The portion 10*h* is connected to an end portion of the portion 10*f* on the side surface 2*c* side, and extends from a connection portion with the portion 10*f* toward the end surface 2*a* and the side surface 2*e*. The portion 10*h* has, for example, a line-symmetrical shape with the portion 10*g*. The portion 10*g* and the portion 10*h* are connected to each other.

The coil conductor 5*c* configures one end portion of the coil 10. One end portion of the coil conductor 5*c* and the connection conductor 6 connected to the mounting conductor 4 are adjacent to each other in the direction D1 and are connected to each other. The other end portion of the coil conductor 5*c* and one end portion of the coil conductor 5*d* are adjacent to each other in the direction D3 and are connected to each other. In the present embodiment, the other end portion of the coil conductor 5*c* is located closer to the side surface 2*f* than the one end portion of the coil conductor 5*d*. The other end portion of the coil conductor 5*d* and one end portion of the coil conductor 5*e* are adjacent to each other in the direction D3 and are connected to each other. In the present embodiment, the other end portion of the coil conductor 5*d* is located closer to the side surface 2*f* than the one end portion of the coil conductor 5*e*. The other end portion of the coil conductor 5*e* and one end portion of the coil conductor 5*f* are adjacent to each other in the direction D3 and are connected to each other. In the present embodiment, the other end portion of the coil conductor 5*e* is located closer to the side surface 2*f* than the one end portion of the coil conductor 5*f*. The other end portion of the coil conductor 5*f* and the connection conductor 7 connected to the mounting conductor 3 are adjacent to each other in the direction D1 and are connected to each other.

As illustrated in FIG. 2, the coil conductors 5*c*, 5*d*, 5*e*, and 5*f* are configured by laminating a plurality of coil conductor layers 15*c*, 15*d*, 15*e*, and 15*f* in the direction D3. The plurality of coil conductor layers 15*c*, 15*d*, 15*e*, and 15*f* is disposed such that all the coil conductor layers overlap with one another as viewed in the direction D3. In the present embodiment, the coil conductor 5*c* is configured by three coil conductor layers 15*c*. The coil conductor 5*d* is configured by three coil conductor layers 15*d*. The coil conductor 5*e* is configured by three coil conductor layers 15*e*. The coil conductor 5*f* is configured by three coil conductor layers 15*f*. In the coil conductors 5*c*, 5*d*, 5*e*, and 5*f*, the plurality of coil conductor layers 15*c*, 15*d*, 15*e*, and 15*f* are integrated to such an extent that boundaries between the layers cannot be visually recognized. The coil conductors 5*c*, 5*d*, 5*e*, and 5*f* may be each configured by one of the coil conductor layers 15*c*, 15*d*, 15*e*, and 15*f*.

The connection conductor 6 extends in the direction D1 and is connected to the coil conductor 5*c* of the coil 10 and the conductor portion 41. The connection conductor 6 (internal conductor 5) is connected to at least one of the second surface 44*a* and the third surface 44*b* of the second region 44 and away from the connection portion between the first surface 43*a* and the third surface 44*b*. In the present embodiment, the connection conductor 6 (internal conductor 5) is connected to the connection portion between the second surface 44*a* and the third surface 44*b*.

The connection conductor 7 extends in the direction D1 and is connected to the coil conductor 5*f* and the conductor portion 31. The connection conductor 7 (internal conductor 5) is connected to at least one of the second surface 34*a* and the third surface 34*b* of the second region 34 and away from the connection portion between the first surface 33*a* and the third surface 34*b*. In the present embodiment, the connection conductor 7 (internal conductor 5) is connected to the connection portion between the second surface 34*a* and the third surface 34*b*. In the present embodiment, in the multilayer coil component 1, the connection conductors 6 and 7 start from the outer edges 35*a* and 45*a* of the mounting conductors 3 and 4, and are connected at positions closer to the side surface 2*c* than the outer edges 35*a* and 45*a*. In other words, the connection conductors 6 and 7 are connected to the mounting conductors 3 and 4 only on the second surfaces 34*a* and 44*a*.

The connection conductors 6 and 7 are configured by laminating a plurality of connection conductor layers 16 and 17 in the direction D3. In the present embodiment, the connection conductor 6 is configured by three connection conductor layers 16. The connection conductor 7 is configured by three connection conductor layers 17. In the connection conductors 6 and 7, the plurality of connection conductor layers 16 and 17 are integrated to such an extent that boundaries between the layers cannot be visually recognized. The connection conductors 6 and 7 may be configured by the connection conductor layers 16 and 17, respectively.

The mounting conductor layers 13 and 14, the coil conductor layers 15*c*, 15*d*, 15*e*, and 15*f*, and the connection conductor layers 16 and 17 are configured by a conductive material. The conductive material contains, for example, Ag or Pd. These layers may be configured by the same material or different materials.

As illustrated in FIG. 2, the multilayer coil component 1 has a plurality of layers La, Lb, Lc, Ld, Le, and Lf. The multilayer coil component 1 is configured by laminating two layers La, one layer Lb, three layers Lc, three layers Ld, three layers Le, three layers Lf, one layer Lb, and two layers La in order from the side surface 2*f* side. With the configuration, the multilayer coil component 1 forms a spiral structure in which the coil 10 ascends counterclockwise along the coil axis 10*a*.

The layer La is configured by the element layer 12*a*.

The layer Lb is configured by a combination of the element layer 12*b* and the mounting conductor layers 13 and 14. The element layer 12*b* is provided with defect portions Rb which have shapes corresponding to the shapes of the mounting conductor layers 13 and 14 and into which the mounting conductor layers 13 and 14 are fit. The shape of the element layer 12*b* and the overall shape of the mounting conductor layers 13 and 14 have a complementary relationship with each other.

The layer Lc is configured by a combination of the element layer 12*c*, the mounting conductor layers 13 and 14, and the coil conductor layer 15*c*. The element layer 12*c* is provided with defect portions Re. The defect portions Rc have shapes corresponding to the shapes of the mounting conductor layers 13 and 14 and the coil conductor layer 15*c*. The mounting conductor layers 13 and 14, the coil conductor layer 15*c*, and the connection conductor layer 16 are fitted in the defect portions Re. The shape of the element layer 12*c* and the overall shape of the mounting conductor layers 13 and 14, the coil conductor layer 15*c*, and the connection conductor layer 16 have a complementary relationship with each other.

The layer Ld is configured by a combination of the element layer 12*d*, the mounting conductor layers 13 and 14 and the coil conductor layer 15*d*. The element layer 12*d* is provided with defect portions Rd. The defect portions Rd have shapes corresponding to the shapes of the mounting conductor layers 13 and 14 and the coil conductor layer 15*d*. The mounting conductor layers 13 and 14 and the coil conductor layer 15*d* are fitted in the defect portions Rd. The shape of the element layer 12*d* and the overall shape of the mounting conductor layers 13 and 14 and the coil conductor layer 15*d* have a complementary relationship with each other.

The layer Le is configured by a combination of the element layer 12*e*, the mounting conductor layers 13 and 14 and the coil conductor layer 15*e*. The element layer 12*e* is provided with defect portions Re. The defect portions Re have shapes corresponding to the shapes of the mounting conductor layers 13 and 14 and the coil conductor layer 15*e*. The mounting conductor layers 13 and 14 and the coil conductor layer 15*e* are fitted in the defect portions Re. The shape of the element layer 12*e*, and the overall shape of the mounting conductor layers 13 and 14 and the coil conductor layer 15*e* have a complementary relationship with each other.

The layer Lf is configured by a combination of the element layer 12*f*, the mounting conductor layers 13 and 14, the coil conductor layer 15*f*, and the connection conductor layer 17. The element layer 12*f* is provided with defect portions Rf. The defect portions Rf have shapes corresponding to the shapes of the mounting conductor layers 13 and 14, the coil conductor layer 15*f*, and the connection conductor layer 17. The mounting conductor layers 13 and 14, the coil conductor layer 15*f*, and the connection conductor layer 17 are fitted in the defect portions R*f*. The shape of the element layer 12*f* and the overall shape of the mounting conductor layers 13 and 14, the coil conductor layer 15*f*, and the connection conductor layer 17 have a complementary relationship with each other.

The defect portions Rb, Re, Rd, Re, Rf are integrated to configure the aforementioned recesses 21, 22, 23, and 24. The widths of the defect portions Rb, Re, Rd, Re, and Rf are basically set to be larger than the widths of the mounting conductor layers 13 and 14, the coil conductor layers 15*c*, 15*d*, 15*e*, and 15*f*, and the connection conductor layers 16 and 17. Hereinafter, widths of the defect portions Rb, Re, Rd, Re, and Rf are referred to as "widths of the defect portions". Widths of the mounting conductor layers 13 and 14, the coil conductor layers 15*c*, 15*d*, 15*e* and 15*f*, and the connection conductor layers 16 and 17 are referred to as "widths of the conductor portions". To improve adhesive properties between the element layers 12*b*, 12*c*, 12*d*, 12*e*, and 12*f*, and the mounting conductor layers 13 and 14, the coil conductor layers 15*c*, 15*d*, 15*e*, and 15*f*, and the connection conductor layers 16 and 17, the widths of the defect portions may be purposely set to be narrower than the widths of the conductor portions. A value obtained by subtracting the width of the conductor portion from the width of the defect portion is favorably, for example, from −3 μm to 10 μm, both inclusive, and more favorably from 0 μm to 10 μm, both inclusive.

Figure 4:
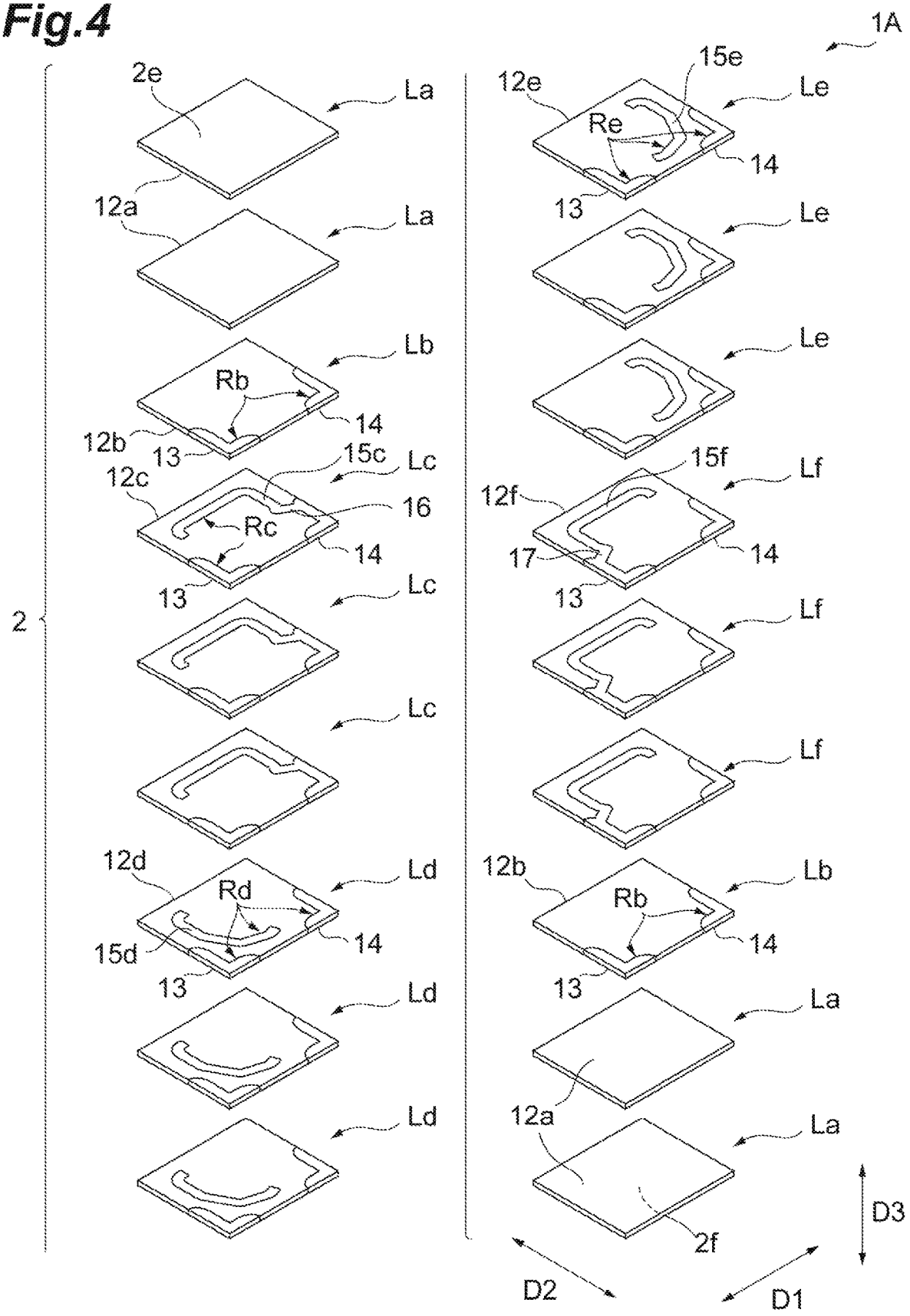
FIG. 4 is an exploded perspective view of a multilayer coil component according to a modification of the present embodiment.

Next, a multilayer coil component 1A according to a modification of the present embodiment will be described with reference to FIGS. 4 and 5. FIG. 4 is an exploded perspective view of the multilayer coil component 1A. FIG.

5 is a plan view illustrating a relationship between a coil and a mounting conductor illustrated in FIG. 4. FIG. 5 is a plan view of the multilayer coil component 1A as viewed from the side surface 2*e* side, and the element 2 is illustrated by the broken line. The modification illustrated in FIGS. 4 and 5 is different from the above-described embodiment in having a spiral structure in which the coil 10 ascends clockwise along the coil axis 10*a*, and in positions where the connection conductors 6 and 7 are connected to the mounting conductors 3 and 4. Hereinafter, the differences between the above-described embodiment and the modification will be mainly described.

In the present modification, the coil conductor 5*c* configures one end portion of the coil 10. One end portion of the coil conductor 5*c* and the connection conductor 6 connected to the mounting conductor 4 are adjacent to each other in the direction D1, and are connected to each other. The other end portion of the coil conductor 5*c* and one end portion of the coil conductor 5*d* are adjacent to each other in the direction D3, and are connected to each other. In the present modification, the other end portion of the coil conductor 5*c* is located closer to the side surface 2*d* than the one end portion of the coil conductor 5*d*. The other end portion of the coil conductor 5*d* and one end portion of the coil conductor 5*e* are adjacent to each other in the direction D3, and are connected to each other. In the present modification, the other end portion of the coil conductor 5*d* is located closer to the side surface 2*d* than the one end portion of the coil conductor 5*e*. The other end portion of the coil conductor 5*e* and one end portion of the coil conductor 5*f* are adjacent to each other in the direction D3, and are connected to each other. In the present modification, the other end portion of the coil conductor 5*e* is located closer to the side surface 2*d* than the one end portion of the coil conductor 5*f*. The other end portion of the coil conductor 5*f* and the connection conductor 7 connected to the mounting conductor 3 are adjacent to each other in the direction D1, and are connected to each other.

As illustrated in FIG. 4, the multilayer coil component 1A also includes a plurality of layers La, Lb, Lc, Ld, Le, and Lf, similarly to the multilayer coil component 1. The multilayer coil component 1A is configured by two layers La, one layer Lb, three layers Lc, three layers Ld, three layers Le, three layers Lf, one layer Lb, and two layers La laminated in order from the side surface 2*f* side. With the configuration, the multilayer coil component 1A forms the spiral structure in which the coil 10 ascends clockwise along the coil axis 10*a*.

Figure 5:
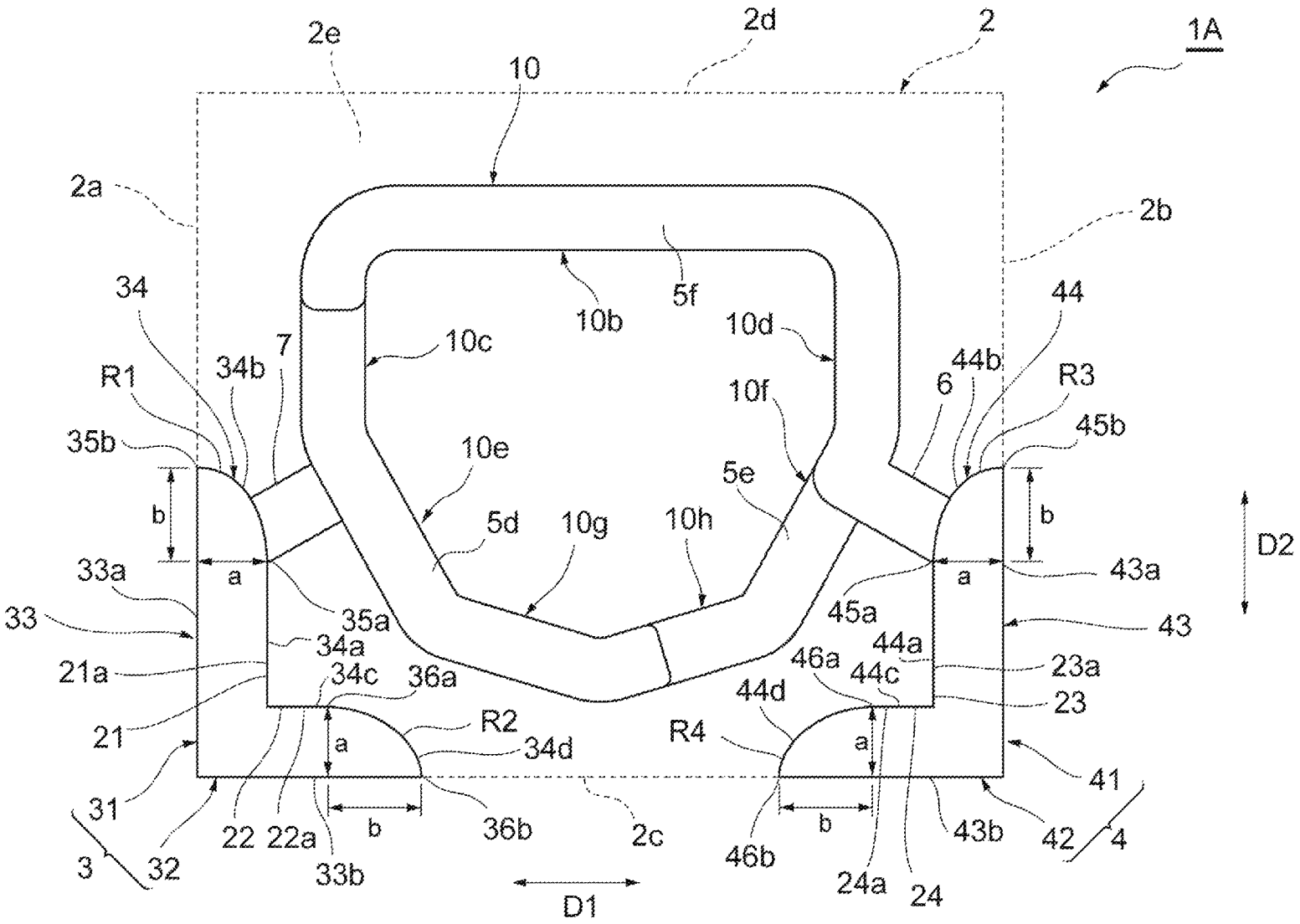
FIG. 5 is a plan view illustrating a relationship between a coil and a mounting conductor illustrated in FIG. 4.

In the multilayer coil component 1A illustrated in FIG. 5, the connection conductors 6 and 7 start from the outer edges 35*a* and 45*a* of the mounting conductors 3 and 4, and are connected at positions that are closer to the side surface 2*d* than the outer edges 35*a* and 45*a*. That is, in the multilayer coil component 1A, the connection conductor 6 is connected to the mounting conductor 4 at a position between the outer edge 45*a* and the outer edge 45*b*. The connection conductor 7 is connected to the mounting conductor 3 at a position between the outer edge 35*a* and the outer edge 35*b*. In other words, the connection conductors 6 and 7 are connected to the mounting conductors 3 and 4 only on the third surfaces 34*b* and 44*b*.

Figure 6:
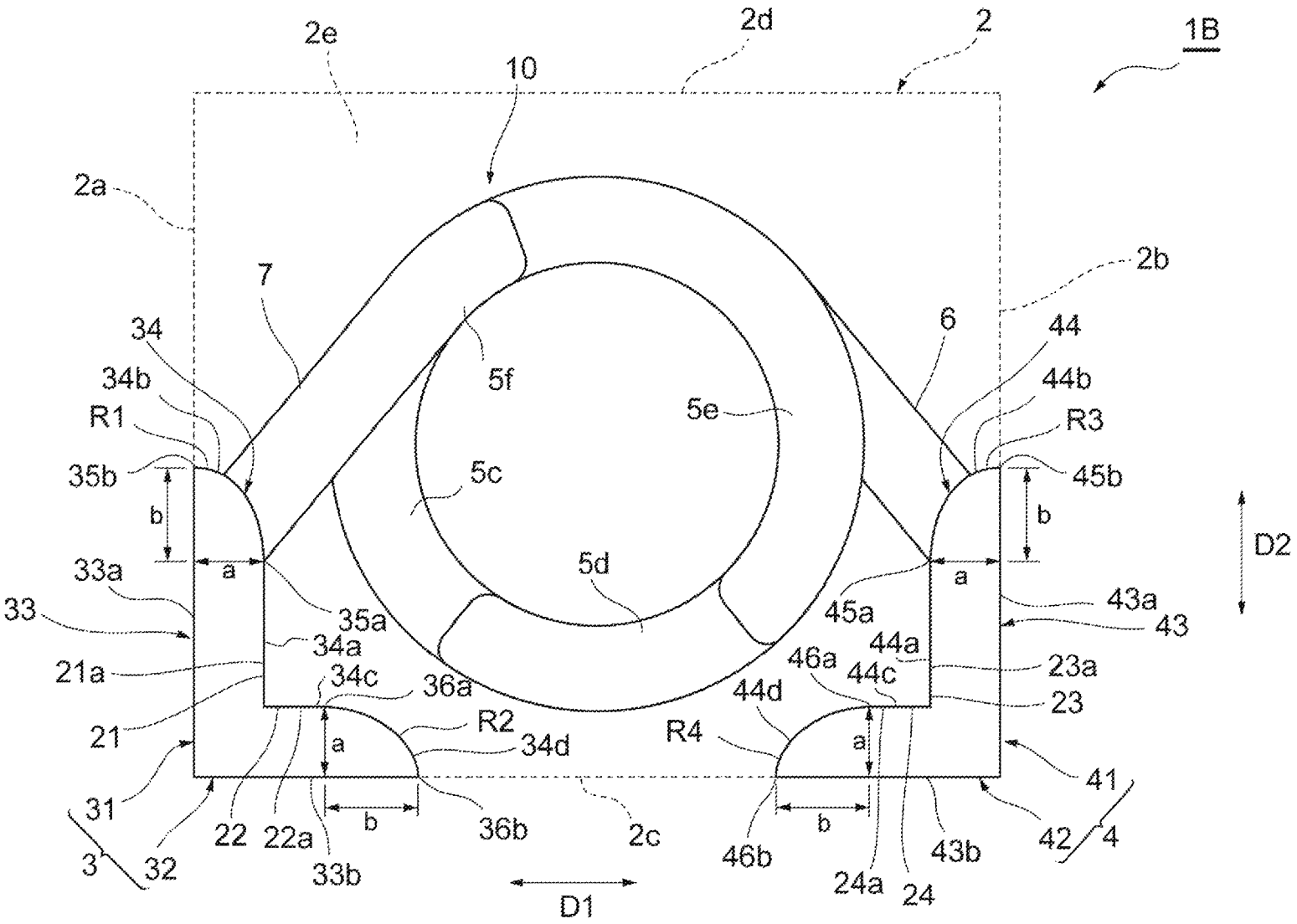
FIG. 6 is a plan view illustrating a relationship between a coil and a mounting conductor in a multilayer coil component according to a modification of the present embodiment.

Next, a multilayer coil component 1B according to a modification of the present embodiment will be described with reference to FIG. 6. FIG. 6 is a plan view illustrating a relationship between a coil and a mounting conductor in the multilayer coil component 1B. FIG. 6 is a plan view of a multilayer coil component 1B as viewed from the side surface 2*e* side, and the element 2 is illustrated by the broken line. The modification illustrated in FIG. 6 is different from the above-described embodiment in that the coil 10 has a circular shape as viewed in the direction D3. Hereinafter, the difference between the above-described embodiment and the modification will be mainly described.

The multilayer coil component 1B forms a spiral structure in which the coil 10 ascends counterclockwise along the coil axis 10*a*. As illustrated in FIG. 6, in the multilayer coil component 1B, the coil 10 has a circular shape as viewed in the direction D3. The length of the coil 10 in the direction D2 is from 10% to 90%, both inclusive, and more favorably from 10% to 50%, both inclusive, of the length of the multilayer coil component 1 in the direction D2, as viewed in the direction D1.

The coil 10 is disposed in a central portion of the multilayer coil component 1B in the direction D1 as viewed in the direction D2. That is, a separation distance between the coil 10 and the end surface 2*a* in the direction D1 and a separation distance between the coil 10 and the end surface 2*b* in the direction D1 are equal to each other. The coil 10 is disposed in a central portion of the multilayer coil component 1B in the direction D2 as viewed in the direction D1. That is, a separation distance between the coil 10 and the side surface 2*c* in the direction D2 and a separation distance between the coil 10 and the side surface 2*d* in the direction D2 are equal to each other. The separation distances between the coil 10 and the side surfaces 2*c* and 2*d* in the direction D2 are from 1.5% to 30%, both inclusive, and more favorably from 1.5% to 10%, both inclusive, of the length of the multilayer coil component 1B in the direction D2.

An example of a method for manufacturing the multilayer coil component 1 according to the embodiment will be described.

First, an element forming layer is formed by applying to a base material an element paste containing a constituent material of the above described element layers 12*a* to 12*f* and a photosensitive material. The base material includes, for example, a PET film. The photosensitive material contained in the element paste may be either a negative type or a positive type, and a known photosensitive material can be used. Next, the element forming layer is exposed and developed by a photolithography method using a Cr mask, for example, to form on the bases material an element pattern from which a shape correspond to the shape of a conductor forming layer described below is removed. The element pattern is a layer to serve as the element layer 12*b*, 12*c*, 12*d*, 12*e*, or 12*f* after thermal treatment. That is, the element pattern provided with defect portions that are to serve as the defect portions Rb, Rc, Rd, Re, or Rf is formed. That the "photolithography method" of the present embodiment is not limited to a type of mask or the like as long as a layer to be processed containing the photosensitive material is exposed and developed in such a manner as to have a desired pattern.

Meanwhile, a conductor forming layer is formed by applying to the base material a conductor paste containing a photosensitive material and constituent materials of the mounting conductor layers 13 and 14, the coil conductor layers 15*c*, 15*d*, 15*e*, and 15*f*, and the connection conductor layers 16 and 17. The base material includes, for example, a PET film. The photosensitive material contained in the conductor paste may be either a negative type or a positive type, and a known photosensitive material can be used. Next, the conductor forming layer is exposed and developed by a photolithography method using a Cr mask, for example, to form a conductor pattern on the base material. The conductor pattern is a layer to serve as the mounting conductor layer 13 or 14, the coil conductor layer 15*c*, 15*d*, 15*e*, or 15*f* or the connection conductor layer 16 or 17 after thermal treatment.

Next, the element forming layer is transferred from the base material onto a support. In the present embodiment, two element forming layers are laminated on the support by repeating the transfer step of the element fowling layer twice. These element forming layers are layers to serve as the layers La after thermal treatment.

Next, the conductor patterns and the element patterns are repeatedly transferred onto the support, thereby being laminated in the direction D3. Specifically, first, the conductor pattern is transferred from the base material onto the element forming layer. Next, the element pattern is transferred from the base material onto the element forming layer. The conductor pattern is combined with the defect portion of the element pattern, and the element pattern and the conductor pattern are formed as the same layer on the element forming layer. Further, the transfer steps of the conductor pattern and element pattern are repeatedly performed, and the conductor pattern and the body pattern are laminated in such a manner as to be combined with each other. With the process, layers to serve as the layers Lb, Lc, Ld, Le, and Lf after thermal treatment are laminated.

Next, the element forming layer is transferred from the base material onto the layer laminated in the transfer steps of the conductor pattern and the element pattern. In the present embodiment, two element forming layers are laminated on the layer, laminated in the transfer steps of the conductor pattern and the element pattern, by repeating the transfer step of the element forming layer twice. These element forming layers are layers to serve as the layers La after thermal treatment.

By the above processes, a laminate that configures the multilayer coil component 1 by thermal treatment is formed on the support. Next, the obtained laminate is cut into a predetermined size. Next, after a de-binding process is performed for the cut laminate, thermal treatment is performed. The thermal treatment temperature is about, for example, 850 to 900° C. Next, if necessary, plating layers are formed on the outer surfaces of the mounting conductors 3 and 4. With the above processes, the multilayer coil component 1 is obtained.

As described above, in the multilayer coil component 1, 1A, or 1B, the second surfaces 34*a* and 44*a* and the third surfaces 34*b* and 44*b* overlap with the first surfaces 33*a* and 43*a* as viewed in the direction in which the first surfaces 33*a* and 43*a* and the second surfaces 34*a* and 44*a* face each other. Therefore, the volumes of the mounting conductors 3 and 4 are reduced at the third surfaces 34*b* and 44*b* connected to the second surfaces 34*a* and 44*a* while the surface areas of the first regions 33 and 43 are maintained, as compared with a case where the second surfaces 34*a* and 44*a* and the third surfaces 34*b* and 44*b* are provided not to overlap with the first surfaces 33*a* and 43*a*. In this multilayer coil component 1, 1A, or 1B, the internal conductor 5 is connected to the second regions 34 and 44 away from the connection portions between the first surfaces 33*a* and 43*a* and the third surfaces 34*b* and 44*b*. Thus, the portions where the volumes of the mounting conductors 3 and 4 are reduced are not filled with the constituent material of the connection conductors 6 and 7 of the internal conductor 5 in the vicinity between the region where the mounting conductors 3 and 4 are exposed from the element 2 and the region where the mounting conductors 3 and 4 are covered by the element 2. Therefore, the shrinkage of the constituent materials of the mounting conductors 3 and 4 and the internal conductor 5 are reduced at positions where cracks easily occur, and thus the occurrence of cracks in the element 2 is suppressed.

The angles made by the first surfaces 33*a* and 43*a* and planes that pass through the connection portions between the first surfaces 33*a* and 43*a* and the third surfaces 34*b* and 44*b* and pass through the connection portions between the second surfaces 34*a* and 44*a* and the third surfaces 34*b* and 44*b* are acute angles. In this case, in the vicinity between the regions where the mounting conductors 3 and 4 are exposed from the element 2 and the regions where the mounting conductors 3 and 4 are covered by the element 2, the volumes of the mounting conductors 3 and 4 are further reduced.

The third surfaces 34*b* and 44*b* are located closer to the second surfaces 34*a* and 44*a* than a plane passing through the connection portion between the first surfaces 33*a* and 43*a* and the third surfaces 34*b* and 44*b* and orthogonal to the first surfaces 33*a* and 43*a*. In this case, in the vicinity between the regions where the mounting conductors 3 and 4 are exposed from the element 2 and the regions where the mounting conductors 3 and 4 are covered by the element 2, the volumes of the mounting conductors 3 and 4 are further reduced.

The first regions 33 and 43 further include the mounting surfaces 33*b* and 43*b* connected to the first surfaces 33*a* and 43*a* and extending in the direction intersecting with the first surfaces 33*a* and 43*a*. The internal conductor 5 is connected to at least one of the second surfaces 34*a* and 44*a* and the third surfaces 34*b* and 44*b*. Therefore, when the multilayer coil component 1, 1A, or 1B is mounted on another electronic component, the influence of another electronic component on electromagnetic characteristics of the connection portions between the internal conductor 5 and the mounting conductors 3 and 4 is suppressed. In the present embodiment, since the internal conductor 5 includes the coil conductors 5*c*, 5*d*, 5*e*, and 5*f*, generation of magnetic flux in the connection portions between the internal conductor 5 and the mounting conductors 3 and 4 is less likely to be inhibited by another electronic component. Therefore, the decrease in the Q value (quality factor) of the coil 10 is suppressed. For example, in a case where the multilayer coil component 1, 1A, or 1B is mounted on another electronic device by solder connection, since the solder is provided not only on the mounting surfaces but also on the first surfaces 33*a* and 43*a*, the mounting strength can be increased.

The connection conductors 6 and 7 of the internal conductor 5 are connected to the connection portions between the second surfaces 34*a* and 44*a* and the third surfaces 34*b* and 44*b*. In this case, the influence of another electronic component on the electromagnetic characteristics of the connection portions between the internal conductor 5 and the mounting conductors 3 and 4 is suppressed, the shrinkage of the constituent materials of the mounting conductors 3 and 4 and the internal conductor 5 at the positions where cracks easily occur is reduced, and the suppression and the reduction are balanced.

In the multilayer coil component 1 or 1B, the connection conductors 6 and 7 of the internal conductor 5 are connected to the mounting conductors 3 and 4 only on the second surfaces 34*a* and 44*a*. In this case, the shrinkage of the constituent materials of the mounting conductors 3 and 4 and the internal conductor 5 at the positions where cracks easily occur is reduced.

In the multilayer coil component 1A, the connection conductors 6 and 7 of the internal conductor 5 are connected to the mounting conductors 3 and 4 only on the third surfaces 34*b* and 44*b*. In this case, when the multilayer coil component 1A is mounted on another electronic component, the influence of another electronic component on electromagnetic characteristics of the connection portions between the internal conductor 5 and the mounting conductors 3 and 4 is suppressed.

The second regions 34 and 44 include the fourth surfaces 34*c* and 44*c* facing the mounting surfaces 33*b* and 43*b*, and the fifth surfaces 34*d* and 44*d* connecting the fourth surfaces 34*c* and 44*c* and the mounting surfaces 33*b* and 43*b*. The fourth surfaces 34*c* and 44*c* of the second regions 34 and 44 are connected to the second surfaces 34*a* and 44*a*. The fourth surfaces 34*c* and 44*c* and the fifth surfaces 34*d* and 44*d* overlap with the mounting surfaces 33*b* and 43*b* as viewed in the direction in which the mounting surfaces 33*b* and 43*b* and the fourth surfaces 34*c* and 44*c* face each other. For this reason, the volumes of the mounting conductors 3 and 4 are further reduced. Therefore, the shrinkage of the constituent materials of the mounting conductors 3 and 4 and the internal conductor 5 at the positions where cracks easily occur is further reduced.

The mounting conductors 3 and 4 have an L-shape in cross section in the direction orthogonal to the direction in which the first. surfaces 33*a* and 43*a* and the second surfaces 34*a* and 44*a* face each other and to the direction in which the mounting surfaces 33*b* and 43*b* and the fourth surfaces 34*c* and 44*c* face each other. Therefore, a space inside the element 2 is provided.

The third surfaces 34*b* and 44*b* are curved. For example, in a case where the third surface 34*b* or 44*b* is configured by a plurality of planes and has a chamfered shape, there is a possibility of concentration of stress on corner portions of the third surface 34*b* or 44*b*. In contrast, in the multilayer coil component 1, 1A, or 1B, since the third surfaces 34*b* and 44*b* are curved, the stress is relieved. Therefore, the occurrence of cracks in the element 2 is further suppressed.

The relationship $0.75a \leq b \leq 2a$ is satisfied where the shortest distance from the connection portions between the second surfaces 34*a* and 44*a* and the third surfaces 34*b* and 44*b* to the first surfaces 33*a* and 43*a* is "a", and the shortest distance from the connection portions between the first surfaces 33*a* and 43*a* and the third surfaces 34*b* and 44*b* to the connection portions between the second surfaces 34*a* and 44*a* and the third surfaces 34*b* and 44*b* as viewed in the direction in which the first surfaces 33*a* and 43*a* and the second surfaces 34*a* and 44*a* face each other is "b". With $0.75a \leq b$, the angles between the first surfaces 33*a* and 43*a* and the third surfaces 34*b* and 44*b* become sufficiently large. Therefore, in the vicinity between the regions where the mounting conductors 3 and 4 are exposed from the element 2 and the regions where the mounting conductors 3 and 4 are covered by the element 2, concentration of stress is suppressed. Further, with $b \leq 2a$, the volumes of the mounting conductors 3 and 4 can be sufficiently reduced. Therefore, the shrinkage of the constituent material of the mounting conductors 3 and 4 is reduced. Therefore, the occurrence of cracks in the element 2 is further suppressed.

The internal conductor 5 includes the coil conductors 5*c*, 5*d*, 5*e*, and 5*f* configuring the coil 10 in the element 2 and the connection conductors 6 and 7. The mounting conductors 3 and 4 are configured by laminating the mounting conductor layers 13 and 14. The coil axis 10*a* of the coil 10 is provided along the laminating direction of the mounting conductor layers 13 and 14. The connection conductors 6 and 7 are connected to the second region 34 and 44 away from the connection portions between the first surfaces 33*a* and 43*a* and the third surfaces 34*b* and 44*b*. In this case, the outer diameter of the coil 10 can be increased while the surface areas of the first regions 33 and 43 are maintained, as compared with a case where the second surfaces 34*a* and 44*a* and the third surfaces 34*b* and 44*b* are provided not to overlap with the first surfaces 33*a* and 43*a*. As a result, the Q value of the coil 10 can be improved.

Although the embodiment and modifications of the present invention have been described above, the present invention is not necessarily limited to the above-described embodiment and modifications, and various modifications can be made without departing from the gist thereof.

The multilayer coil component 1 may further include a core portion inside the coil 10 as viewed in the direction D3. The core portion may be hollow. That is, the multilayer coil component 1 may be an air-core coil. The core portion may be solid and may be configured by a magnetic material different from the constituent material of the element 2, for example. The core portion may penetrate the element 2 in the direction D3 or may be covered with the element 2 at both end portions in the direction D3. The multilayer coil component 1 may further include a spacer disposed between the coil conductors 5*c*, 5*d*, 5*e*, and 5*f* in the direction D3, and the spacer may be configured by a magnetic material or a nonmagnetic material different from the constituent material of the element 2, for example.

The mounting conductor 3 may just have either one of the conductor portions 31 and 32, and the element 2 may just be provided with either one of the recesses 21 and 22, corresponding to the conductor portions 31 and 32. The mounting conductor 4 may just have either one of the conductor portions 41 and 42, and the element 2 may just be provided with either one of the recesses 23 and 24, corresponding to the conductor portions 41 and 42.

The regions R1, R2, R3, and R4 may partially include a plane, or the whole regions may be configured from one or a plurality of planes. The regions R1, R2, R3, and R4 may be configured from a plurality of planes and may have a chamfered shape.

The number of each of the coil conductor layers 15*c*, 15*d*, 15*e*, and 15*f* configuring the coil conductors 5*c*, 5*d*, 5*e*, and 5*f* is not limited to three. The number of each of the coil conductor layers 15*c*, 15*d*, 15*e*, and 15*f* may be one, two, or four or more.

The number of each of the connection conductor layers 16 and 17 configuring the connection conductors 6 and 7 is not limited to three. The number of each of the connection conductor layers 16 and 17 may be one, two, or four or more. The larger the number of the connection conductor layers 16 and 17, the larger the connection areas between the connection conductors 6 and 7 and the second regions 34 and 44 in the thickness direction. The thickness direction corresponds to, for example, the direction D3. According to the present invention, even if the connection areas between the connection conductors 6 and 7 and the second regions 34 and 44 in the thickness direction are large, it is suppressed that the portions of the mounting conductors 3 and 4 where the volumes are reduced are filled with the constituent materials of the connection conductors 6 and 7. The portions of the mounting conductors 3 and 4 where the volumes are reduced are the third surfaces 34*b* and 44*b* or the fifth surfaces 34*d* and 44*d*.

In the above-described embodiment, the multilayer coil component 1 has been described as an example of an electronic component. However, the present invention is not limited to the example, and can be applied to a laminated ceramic capacitor, a laminated varistor, a laminated piezoelectric actuator, a laminated thermistor, or another electronic component such as a laminated composite component.

What is claimed is:

1. An electronic component comprising:

an element provided with a recess;

a mounting conductor disposed in the recess; and an internal conductor disposed in the element and connected to the mounting conductor, wherein the mounting conductor has a first region exposed from the element and a second region connected to the first region and covered by the element, the first region includes a first surface, the second region includes a second surface facing the first surface, and a third surface connecting the second surface and the first surface, the second surface and the third surface overlap with the first surface as viewed in a direction in which the first surface and the second surface face each other, the internal conductor is connected to the second region away from a connection portion between the first surface and the third surface, the third surface is curved from a connection portion between the first surface and the third surface to a connection portion between the second surface and the third surface, and a relationship $0.75a \leq b \leq 2a$ is satisfied where a shortest distance from a connection portion between the second surface and the third surface to the first surface is "a", and a shortest distance from the connection portion between the first surface and the third surface to the connection portion between the second surface and the third surface as viewed in the direction in which the first surface and the second surface face each other is "b".

2. The electronic component according to claim 1, wherein an angle made by the first surface and a plane that passes through the connection portion between the first surface and the third surface and passes through a connection portion between the second surface and the third surface is an acute angle.

3. The electronic component according to claim 1, wherein the third surface is located closer to the second surface than a plane passing through the connection portion between the first surface and the third surface and orthogonal to the first surface.

4. The electronic component according to claim 1, wherein the first region further includes a mounting surface connected to the first surface and extending in a direction intersecting with the first surface, and the internal conductor is connected to at least one of the second surface and the third surface.

5. The electronic component according to claim 4, wherein the internal conductor is connected to a connection portion between the second surface and the third surface.

6. The electronic component according to claim 4, wherein the internal conductor is connected to the mounting conductor only on the second surface.

7. The electronic component according to claim 4, wherein the internal conductor is connected to the mounting conductor only on the third surface.

8. The electronic component according to claim 4, wherein the second region includes a fourth surface facing the mounting surface, and a fifth surface connecting the fourth surface and the mounting surface, the fourth surface of the second region is connected to the second surface, and the fourth surface and the fifth surface overlap with the mounting surface as viewed in a direction in which the mounting surface and the fourth surface face each other.

9. The electronic component according to claim 8, wherein the mounting conductor has an L-shaped cross section in a direction orthogonal to a direction in which the first surface and the second surface face each other and to the direction in which the mounting surface and the fourth surface face each other.

10. The electronic component according to claim 1, wherein the internal conductor includes a coil conductor configuring a coil in the element and a connection conductor connecting the coil conductor to the mounting conductor, the mounting conductor is formed by laminating mounting conductor layers, a coil axis of the coil is provided along a laminating direction of the mounting conductor layers, and the connection conductor is connected to the second region to be away from the connection portion between the first surface and the third surface.

* * * * *